US007513319B2

(12) United States Patent
DeVall

(10) Patent No.: US 7,513,319 B2
(45) Date of Patent: Apr. 7, 2009

(54) REAMER BIT

(76) Inventor: Donald L. DeVall, 326 Diamond Ave., Morgantown, WV (US) 26505

( * ) Notice: Subject to any disclaimer, the term of this patent is extended or adjusted under 35 U.S.C. 154(b) by 22 days.

(21) Appl. No.: 11/811,454

(22) Filed: Jun. 11, 2007

(65) Prior Publication Data

US 2007/0251727 A1 Nov. 1, 2007

Related U.S. Application Data

(63) Continuation of application No. 10/863,789, filed on Jun. 8, 2004, now Pat. No. 7,228,922.

(51) Int. Cl.
*E21B 10/43* (2006.01)
*B23D 77/00* (2006.01)
*B23B 51/02* (2006.01)

(52) U.S. Cl. ..... 175/392; 175/398; 175/427; 408/228

(58) Field of Classification Search ..... 175/427, 175/392, 385, 397, 398; 408/224, 81, 228, 408/227

See application file for complete search history.

(56) References Cited

U.S. PATENT DOCUMENTS

| | | | | | |
|---|---|---|---|---|---|
| 716,557 | A | * | 12/1902 | Pinkin | 408/214 |
| 1,045,954 | A | * | 12/1912 | Decker | 175/401 |
| 1,547,459 | A | * | 7/1925 | Stafford et al. | 175/384 |
| 1,701,427 | A | * | 2/1929 | Shields | 175/391 |
| 1,725,299 | A | * | 8/1929 | Pickin | 175/295 |
| 1,809,351 | A | | 6/1931 | Oliver | 175/397 |
| 1,822,216 | A | * | 9/1931 | Hartson | 175/272 |
| 1,923,488 | A | | 8/1933 | Howard et al. | 255/61 |
| 1,940,996 | A | | 12/1933 | Carr | 175/397 |
| 2,032,328 | A | | 2/1936 | Reedy | 255/63 |
| 2,358,052 | A | | 9/1944 | Brown | 255/64 |
| 2,461,395 | A | | 2/1949 | Winn | 175/397 |
| 2,561,472 | A | * | 7/1951 | Hawkinson | 407/29.12 |
| 2,648,524 | A | | 8/1953 | Dionisotti | 255/64 |
| D178,899 | S | | 10/1956 | Olsen | D54/13 |
| 2,815,933 | A | | 12/1957 | Dionisotti | 255/61 |
| D183,237 | S | | 7/1958 | Aven, Jr. | D54/4 |
| 3,140,748 | A | | 7/1964 | Engle et al. | 175/410 |
| 3,179,190 | A | | 4/1965 | Blasi | 175/391 |
| 3,252,525 | A | | 5/1966 | Pyles | 173/27 |

(Continued)

FOREIGN PATENT DOCUMENTS

WO WO 8900473 1/1989

OTHER PUBLICATIONS

Abrasive Technology Everlast® Brand PCD Drill Product Profile downloaded from www.abrasive-tech.com on Aug. 3, 2003.

(Continued)

*Primary Examiner*—Kenneth Thompson
(74) *Attorney, Agent, or Firm*—Price & Adams

(57) ABSTRACT

A drill steel includes a drill bit and a reamer bit. The drill steel rotates the drill bit to form a hole in a work surface and drives forward to insert the reamer bit into the hole. The reamer bit includes a plurality of inserts positioned on a cylindrical drilling surface to ream out the hole by carving channels in the hole interior surface. The inserts include cutting elements that have radiused or arcuate edges.

20 Claims, 6 Drawing Sheets

U.S. PATENT DOCUMENTS

| | | | | | |
|---|---|---|---|---|---|
| 3,592,276 | A | | 7/1971 | Pyles | 175/420.1 |
| 3,613,807 | A | | 10/1971 | Galis | 175/209 |
| 4,098,362 | A | | 7/1978 | Bonnice | 175/329 |
| 4,211,294 | A | | 7/1980 | Multakh | 175/330 |
| 4,259,090 | A | | 3/1981 | Bovenkerk | 51/309 |
| 4,265,574 | A | * | 5/1981 | Eckle | 408/188 |
| 4,294,319 | A | | 10/1981 | Guergen | 175/389 |
| 4,304,311 | A | * | 12/1981 | Shinn | 175/325.4 |
| 4,313,506 | A | | 2/1982 | O'Connell | 175/410 |
| 4,416,337 | A | | 11/1983 | Phillips et al. | 173/198 |
| 4,440,247 | A | | 4/1984 | Sartor | 175/393 |
| 4,471,845 | A | | 9/1984 | Jurgens | 175/329 |
| 4,480,951 | A | * | 11/1984 | Regensburger | 408/224 |
| 4,499,958 | A | | 2/1985 | Radtke et al. | 175/329 |
| 4,534,773 | A | | 8/1985 | Phaal et al. | 51/293 |
| 4,729,441 | A | | 3/1988 | Peetz et al. | 175/385 |
| 4,733,735 | A | | 3/1988 | Barr et al. | 175/393 |
| 4,771,834 | A | | 9/1988 | Treitz | 175/415 |
| 5,010,967 | A | * | 4/1991 | Desai | 175/406 |
| D317,010 | S | | 5/1991 | Knemeyer | D15/21 |
| 5,083,887 | A | * | 1/1992 | Dotany | 407/59 |
| 5,180,022 | A | | 1/1993 | Brady | 175/430 |
| 5,184,689 | A | | 2/1993 | Sheirer et al. | 175/420.1 |
| D340,248 | S | | 10/1993 | Brady | D15/139 |
| 5,303,787 | A | | 4/1994 | Brady | 175/430 |
| D351,174 | S | | 10/1994 | Brady | D15/139 |
| 5,363,932 | A | | 11/1994 | Azar | 175/417 |
| 5,433,281 | A | | 7/1995 | Black | 175/420.1 |
| 5,467,837 | A | | 11/1995 | Miller et al. | 175/420.1 |
| 5,535,839 | A | | 7/1996 | Brady | 175/427 |
| 5,580,196 | A | | 12/1996 | Thompson | 408/145 |
| 5,630,478 | A | | 5/1997 | Schimke | 175/420.1 |
| 5,743,346 | A | | 4/1998 | Flood et al. | 175/420.2 |
| 5,875,858 | A | | 3/1999 | Brady | 175/68 |
| 5,996,714 | A | | 12/1999 | Massa et al. | 175/413 |
| 6,021,857 | A | | 2/2000 | Birk et al. | 175/415 |
| 6,029,544 | A | | 2/2000 | Katayama | 76/108.6 |
| D424,579 | S | | 5/2000 | Brady | D15/21 |
| 6,092,612 | A | | 7/2000 | Brady | 175/325.2 |
| D430,578 | S | | 9/2000 | Brady | D15/21 |
| 6,161,635 | A | | 12/2000 | Brady | 175/393 |
| 6,206,117 | B1 | * | 3/2001 | Tibbitts et al. | 175/399 |
| 6,260,638 | B1 | | 7/2001 | Massa et al. | 175/427 |
| 6,290,007 | B2 | | 9/2001 | Beuershausen et al. | 175/408 |
| 6,374,932 | B1 | | 4/2002 | Brady | 175/428 |
| 6,427,782 | B2 | | 8/2002 | Brady | 175/40 |
| 6,585,064 | B2 | | 7/2003 | Griffin et al. | 175/434 |
| 6,588,520 | B2 | | 7/2003 | Hauptmann | 175/340 |
| 2001/0013428 | A1 | | 8/2001 | Brady | 175/320 |
| 2004/0018064 | A1 | * | 1/2004 | Liu | 408/224 |

OTHER PUBLICATIONS

Diamatec, Inc. Surface-Set Diamond Core Bits Product Profile downloaded from www.diamatec.com on Aug. 3, 2003.

"Diamond Bits & Tooling for World Markets", GeoDrilling International, Aug. 2002, p. 32.

"Diamond, Diamond-like Carbon/CBN Films and Coated Products: Technology Analysis", Global Information, Inc., Aug. 2002 (outline only).

GeoGem Manufacturing Processes Description downloaded from www.geogem.co.uk on Aug. 3, 2003.

Glowka, David A., "Development of Advanced Synthetic-Diamond Drill Bits for Hard-Rock Drilling", U.S. Department of Energy, Apr. 25, 1997.

Radtke, Bob; Smith, Melody; Riedel, Richard; Daniels, Bill; and Gwilliam, William, "New High Strength and Faster Drilling TSP Diamond Cutters", 1999 Oil and Gas Conference—Technology Options for Producer's Survival, U.S. Department of Energy Jun. 28-30, 1999.

Wise, Jack L. and Raymond, David, "Hard-Rock Drill Bit Technology", Sandia National Laboratories, Jul. 17, 2003.

* cited by examiner

REAMER BIT

CROSS REFERENCE TO RELATED APPLICATION

This application is a continuation in part of U.S. patent application Ser. No. 10/863,789 filed on Jun. 8, 2004, U.S. Pat. No. 7,228,922.

BACKGROUND OF THE INVENTION

1. Field of the Invention

This invention relates to an improved rotary cutting tool, and more particularly, to a method and apparatus for drilling a hole in a working surface utilizing a reamer bit in combination with a drill bit.

2. Description of the Related Art

In the fields of industrial, mining and construction tools, drill bits having complex cutting element arrangements and cutting tool inserts are commonly used. In rock drilling operations, it is the conventionally known practice to drill holes in a rock formation by a rotary drill assembly or by a rotary percussion drill assembly. These assemblies include a drill pot that carries a hydraulic motor having a motor shaft rotatably connected to a bevel gear which meshes with another bevel gear rotatably journaled on a support member or hub within the drill housing. It is affixed to a rotatable head or cover, which has a seat into which the shank of a drill steel is received. A drill bit is positioned on the upper end of the drill steel. With this arrangement, rotation of the motor shaft is transmitted to the drill steel to rotate the drill bit.

Many examples of drill bits are known in the art. U.S. Design Pat. No. 178,899 discloses an ornamental design for a drill bit. The drill bit includes three teeth that extend from the distal end of the drill bit and intersect at a point in the center of the distal end. The teeth are separated by a large angular space. The cutting surface of each tooth includes a series of uniform steps.

U.S. Pat. No. 5,184,689 discloses a rotary drill bit that includes a cylindrical body, two dust openings, and a working surface having an insert. The insert includes a simple tapered edge. The drill bit also includes a back relief surface, which can help to remove dislodged material from a working surface, as the drill bit rotates during drilling operations.

U.S. Pat. No. 5,433,281 discloses a roof drill bit having a plurality of equally spaced cutting elements. The cutting elements are V-shaped, not rounded. The cutting elements are spaced symmetrically about an axis that runs from the connecting end of the drill bit to the distal end of the drill bit.

U.S. Pat. No. 4,771,834 discloses a drill bit that includes a plurality of cutting teeth extending from a cutting surface on the distal end of a drill bit. The cutting teeth also extend radially, outwardly from the center of the cutting surface and intersect at the center point of a cutting surface on the drill bit. Each tooth includes a pair of conical cutting elements symmetrically positioned on the tooth. The bit also includes a plurality of pockets for collecting debris from a working surface.

U.S. Pat. No. 4,471,845 discloses a drill bit that includes a plurality of cutting teeth extending from a cutting surface on the distal end of a drill bit. The cutting teeth also extend radially, outwardly from the center of the cutting surface and intersect at the center point of the cutting surface on the drill bit. Each tooth includes a plurality of rounded cutting elements symmetrically positioned on the tooth.

U.S. Pat. No. 6,290,007 discloses a drill bit that includes a plurality of cutting teeth extending from a cutting surface on the distal end of a drill bit. The cutting teeth also extend radially, outwardly from the center of the cutting surface. Each tooth includes a plurality of cutting elements symmetrically positioned on the tooth. Accordingly, conventional drill bits include symmetrically positioned cutting elements and cutting teeth.

Polycrystalline diamond (PCD) is now in wide use, sometimes called polycrystalline diamond compacts (PDC), in making drill bits. U.S. Pat. No. 6,427,782 discloses that PCD materials that are formed of fine diamond powder sintered by intercrystalline bonding under high temperature/high pressure diamond synthesis technology into predetermined layers or shapes; and such PCD layers are usually permanently bonded to a substrate of "precemented" tungsten carbide to form such PDC insert or compact.

The term "high density ceramic" (HDC) is sometimes used to refer to a mining tool having a PCD insert. "Chemical vapor deposition" (CVD) and "Thermally Stable Product" (TSP) diamond-forms may be used for denser inserts and other super abrasive hard surfacing and layering materials, such as layered "nitride" compositions of titanium (TiN) and carbon (C2 N2) and all such "hard surface" materials well as titanium carbide and other more conventional bit materials are applicable to the present invention.

Although many of the drill bits solve the problems discussed above, there is a need for an unconventional reamer bit that has the ability to work in combination with an unconventional "hard surface" drill bit to drill larger holes.

SUMMARY OF THE INVENTION

In accordance with the present invention there is provided a drill bit for reaming the interior surface of a bore. A cylindrical body portion has a longitudinal axis and a cutting surface positioned on the cylindrical body portion cylindrical surface. A pair of inserts project outwardly from the cylindrical body portion cutting surface essentially perpendicular to the cylindrical body portion longitudinal axis. The first insert has a raised cutting element positioned for rotation about the cylindrical body portion longitudinal axis to carve the bore interior surface to increase the width of the bore. The second insert has a cutting element positioned for rotation about the cylindrical body portion longitudinal axis to carve a second hole adjacent to the first hole in the bore interior surface to increase the width of the bore.

Further in accordance with the present invention, there is provided a method for drilling a work surface. An essentially cylindrical drill steel having a drill bit and a reamer bit with a plurality of essentially arcuate cutting elements in an overlying relationship with the work surface is provided. The drill steel is rotated to engage the drill bit with the work surface to form an essentially cylindrical hole therein. The drill steel is driven into the hole to insert the reamer bit therein. The reamer bit arcuate cutting elements are contacted with the hole cylindrical surface. The drill steel is rotated so that the reamer bit cutting elements carve a plurality of channels into the hole cylindrical surface to increase the hole diameter.

Further in accordance with the present invention, there is provided an apparatus for drilling a work surface. A drill steel has a drill bit at one end and a reamer bit adjacent to the drill bit. The drill bit having a cutting surface positioned at one end and means for forming a hole in the work surface extending from the cutting surface. The reamer bit has a cutting surface positioned along an outer cylindrical surface with a pair of inserts projecting outwardly from the reamer bit cutting surface and being essentially perpendicular to the drill bit cutting teeth. The inserts have means for carving a plurality of essentially adjacent channels in the working surface to remove additional material to increase the hole diameter.

Accordingly, a principal object of the present invention is to provide a reamer bit for increasing the size of a hole.

Another object of the present invention is to provide a reamer bit having radiused inserts for reaming holes.

A further object of the present invention is to provide a drill steel having an improved drill bit and an improved reamer bit.

A further object of the present invention is to provide a cylindrical reamer bit having asymmetrically positioned inserts on an outer cylindrical surface that is used in combination with an improved drill bit.

These and other objects of the present invention will be more completely described and disclosed in the following specification, accompanying drawings, and appended claims.

DESCRIPTION OF THE PREFERRED EMBODIMENTS

The present invention is particularly adapted for use in drilling bolt holes in a mine roof of an underground mine, as described in U.S. Pat. No. 4,416,337. A drill steel carries the drill bit at its upper end portion for dislodging rock material. The drill bit and drill steel are mounted in conventional chuck assemblies, as part of a rotary drill assembly. The drill steel and drill bit are centrally bored to facilitate removal from the drilled hole rock dust ground by the bit.

Figure 3:
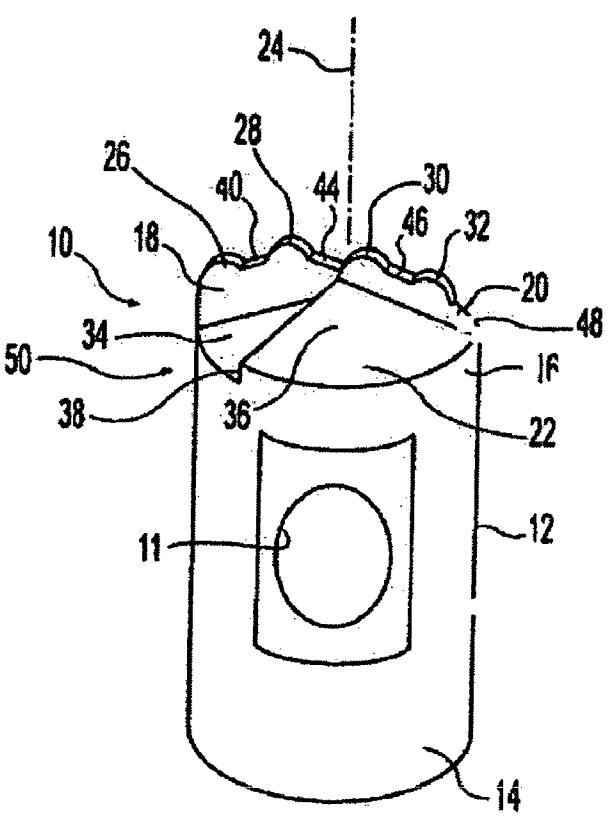
FIG. 3 is an isometric view of the drill bit shown in FIG. 1.
Figure 2:
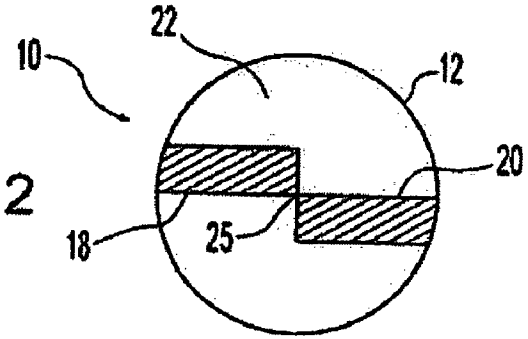
FIG. 2 is a sectional top plan view of the drill bit shown in FIG. 1, illustrating the offset relationship of the asymmetrically positioned cutting teeth.
Figure 1:
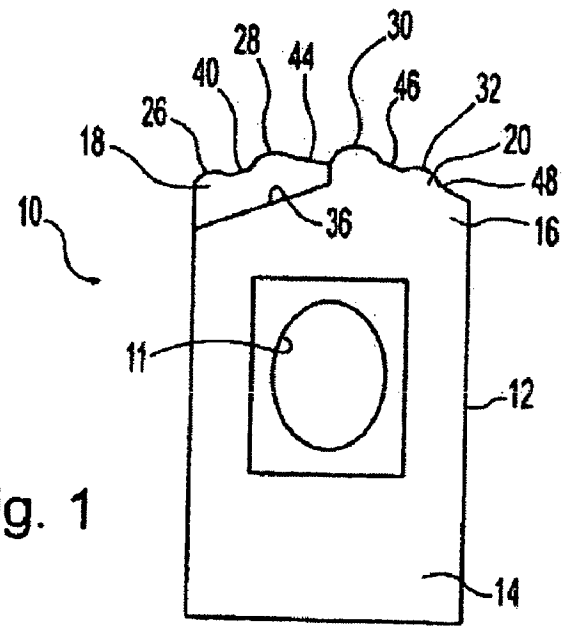
FIG. 1 is a view in side elevation of one embodiment of a drill bit, illustrating a pair of asymmetrically positioned cutting teeth extending in offset relationship on the longitudinal axis of the drill bit.

Referring to the drawings and, particularly, to FIGS. 1-3, there is illustrated an improved drill bit generally designated by the numeral 10. The drill bit 10 has a cylindrical body portion 12 with two opposing dust collection openings 11. The cylindrical body portion 12 includes a drill steel engaging portion 14 at one end and a bit end portion 16 at the opposite end. The drill steel engaging portion 14 attaches to a drill steel (not shown) through conventional connection devices.

The bit end portion 16 includes an integral first cutting tooth 18 and an integral second cutting tooth 20 for contacting and carving a working surface. The cutting teeth 18, 20 extend from the bit end portion 16 of the drill bit 10, and more particularly, from a surface 22 on the bit end portion 16 of the drill bit 10. The cutting teeth 18 and 20 extend in a direction parallel to a longitudinal axis 24 (FIG. 3) of body portion 12 that runs from the drill steel engaging portion 14 of the drill bit 10 to the bit end portion 16 of the drill bit 10. As shown in FIG. 3, the cutting teeth 18 and 20 abut one another at point 25 at the longitudinal axis 24 in a heel-to-toe configuration. With this arrangement the cutting teeth 18 and 20 are laterally displaced or offset from one another, as they extend parallel to the drill bit longitudinal axis.

As shown in FIG. 3, the cutting tooth 18 includes a plurality of integral cutting elements 26, 28. The cutting tooth 20 also includes a plurality of integral cutting elements 30, 32. The cutting elements 26, 28 and 30, 32 carve a working surface. The cutting elements 26, 28 and 30, 32 shown in FIGS. 1-3 are asymmetrically positioned relative to the longitudinal axis 24 and are offset from one another to produce a cutting pattern on a working surface that operates at a lower temperature with a longer bit life. The cutting elements 26, 28 and 30, 32 radiate outwardly from the center of the cutting surface 22 to create the appearance of alternating peaks and valleys when viewed in perspective, as shown in FIG. 3.

As shown in FIG. 2, the cutting teeth 18 and 20 are laterally offset from one another and abut one another at a common point 25 on the surface 22. As shown in FIG. 3, the surface 22 also includes two adjacent surfaces 34, 36 that are separated by a wall 38. The surfaces 34, 36 support the cutting teeth 18 and 20 respectively. The first cutting tooth 18 extends from surface 34. The second cutting tooth 20 extends from surface 36. The surfaces 34 and 36 slope away from the cutting teeth 18 and 20 to provide for efficient evacuation of dislodged materials from the drill bit 10. This permits the drill bit 10 to operate at a lower temperature (has a cooling effect) so that the life of the cutting teeth 18 and 20 is extended.

As shown in FIGS. 1 and 3, the cutting elements 26, 28 and 30, 32 are spaced apart from one another on the cutting teeth 18 and 20, respectively. The cutting elements 26, 28 are separated by a downwardly sloping linear edge portion 40. The first cutting element 26 is positioned adjacent to the cylindrical body portion 12 of the drill bit 10. The second cutting element 28 is positioned adjacent to the center of the surface 34. A second, downwardly sloping linear edge portion 44 extends from the second cutting element 28 to the abutment point 25, as shown in FIG. 2.

As shown in FIG. 1, the downwardly sloping linear edge portions 40, 44 slope in opposite directions. Linear edge portion 40 slopes toward the exterior surface of the cylindrical body portion 12. Linear edge portion 44 slopes downwardly toward the longitudinal axis 24 of body portion 12. Alternatively, the linear edge portions are sloped in the same direction or are flat relative to the surface 34.

As shown in FIG. 1, each cutting element 26, 28 on the cutting tooth 18 has an arcuate configuration and is positioned on the cutting tooth 18 to create a unique cutting pattern on a working surface. The cutting tooth 18 is not limited to elements 26, 28. Additional cutting elements can be added as necessary. Preferably, the cutting elements 26, 28 have a width corresponding to the width of the linear edge portion 40. However, the width of the cutting elements 26, 28 is not critical.

The cutting elements 30, 32 of the second cutting tooth 20 are also spaced from one another by a downwardly sloping linear edge portion 46. The first cutting element 30 is positioned adjacent to the body portion longitudinal axis 24, shown in FIG. 3. The second cutting element 32 is positioned adjacent to the exterior surface of the body portion 12. A downwardly sloping linear edge portion 48 is positioned adjacent to the second cutting element 32. The linear edge portion 44 of cutting tooth 18 abuts the cutting element 30 of cutting tooth 20 along the longitudinal axis 24.

The linear edge portions 46, 48 slope downwardly in the same direction, as seen in FIGS. 1 and 3. The linear edge portions 46, 48 also slope toward the exterior surface of the cylindrical body portion 12. The linear edge portions 46, 48 are sloped in the same direction in one embodiment and in another embodiment are flat relative to the cutting surface 36.

Each cutting element 30, 32 has an arcuate configuration on the cutting tooth 20. The cutting tooth 20 is not limited to the two cutting elements 30, 32. The cutting tooth 20 can include additional cutting elements, as necessary. Preferably, the cutting elements 30, 32 have a width corresponding to the width of the linear edge portion 46. However, the width of the cutting elements 30, 32 is not critical.

Referring now to FIG. 3, surface 36 is spaced apart from the surface 34 on the drill bit 10. The surface 36 is also positioned above the surface 34 so as to provide a pathway for the evacuation of dislodged material on to surface 34 and away from the bit cutting elements 26, 28, 30, and 32. The wall 38 is positioned parallel to the longitudinal axis 24 and perpendicular to the surfaces 34, 36 to separate the surfaces 34, 36. The wall 38, the cutting tooth 18, and the surface 34 define a pocket generally designated by the numeral 50 in FIG. 3 for removing dislodged material.

The drill bit 10 rotates to carve a working surface. The cutting elements 26, 28 and 30, 32 extend from the cutting teeth 18, 20 to contact and carve a working surface. Cutting elements 28, 30 are the first cutting elements to contact flat working surfaces because the apices of cutting elements 28, 30 extend furthest from the drill bit 10.

The asymmetric positioning of the cutting elements 26, 28 and 30, 32 produces a cutting pattern that includes a series of adjacent, concentric circular channels in a working surface, as the drill bit 10 rotates. Cutting element 30 contacts a working surface. As the drill bit 10 rotates, cutting element 30 carves a circular channel in a working surface. Cutting element 28 also contacts a working surface and carves a concentric, circular channel adjacent to the channel formed by cutting element 30.

As the drill bit 10 rotates, the cutting elements 26, 32 carve concentric, circular channels, in the same method accomplished by cutting elements 28 and 30. Cutting element 32 carves a concentric, circular channel adjacent to the channel formed by cutting element 28. Cutting element 26 carves a concentric, circular channel adjacent to a channel formed by cutting element 32.

Rotation of the drill bit 10 and the carving of a working surface by the cutting elements 26, 28 and 30, 32 dislodges material from the bore hole in the rock formation. The dislodged material falls from the working surface and collects in the pocket 50 on the drill bit 10. Dislodged material is directed into the pocket 50 and is removed therefrom by rotation of the drill bit 10 and the depositing of additional material as the drilling operation proceeds into the rock formation.

The cutting surface 22, and more particularly, the cutting elements 30, 32 are formed by coating a suitable substrate with a hard surface layer. The hard layer covers the entire drill bit or, alternatively, just the cutting surface 22 or cutting element 30, 32. The hard layer is formed from a suitable material, such as diamond, polycrystalline diamond, diamond-like carbon, cubic boron nitride (CBN), titanium (TiN) and carbon (C2 N2). The substrate is any suitable material, such as tungsten carbide, steel, or any other suitable metal or ceramic. In the preferred embodiments, the cutting elements are formed from a diamond, polycrystalline diamond, or diamond-like carbon coating.

The diamond, polycrystalline diamond, or diamond-like carbon coatings are applied using known manufacturing process. Such processes include processes for producing polycrystalline diamond (PCD) bits, thermally stable product (TSP) diamond bits, impregnated diamond bits, or surface set diamond bits. Processes for producing PCD bits are disclosed in U.S. Pat. Nos. 6,585,064, 5,743,346, 5,580,196, and 4,098,362, which are incorporated herein by reference. A process for producing a TSP diamond coating is disclosed in U.S. Pat. No. 4,259,090, which is incorporated herein by reference. Surface set diamond coatings may be made by sintering processes or by infiltration processes. U.S. Pat. No. 6,029,544 discloses a diamond drill bit that is coated by sintering and is incorporated herein by reference. U.S. Pat. No. 4,534,773 discloses a method for preparing a surface set diamond coating and is incorporated herein by reference. U.S. Pat. No. 4,211,294 discloses a method for preparing an impregnated diamond coating and is incorporated herein by reference. In the preferred embodiment, the coatings are applied using coating processes that are provided by American Diamond Tool of Salt Lake City, Utah.

Now referring to FIGS. 4-7 there is illustrated an embodiment of a drill bit 52 in which like elements are also identified by like numerals shown in FIGS. 1-3 for the drill bit 10. Contrary to the embodiment of the drill bit 10 illustrated in FIGS. 1-3, the cutting teeth 54, 56 differ in construction from the cutting teeth 18, 20 illustrated in FIGS. 1-3. First, cutting tooth 54 includes raised arcuate edge portions 58, 60 and lowered arcuate edge portions 62, 64. Cutting tooth 56 includes raised arcuate edge portions 66, 68 and lowered arcuate edge portions 70, 72.

Figure 6:
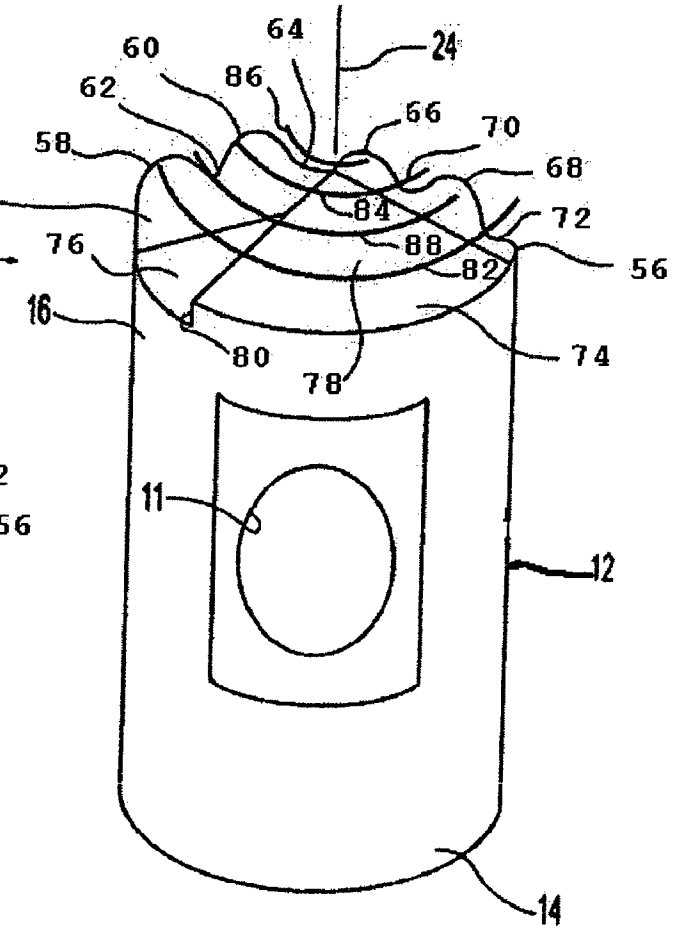
FIG. 6 is an isometric view of the drill bit shown in FIG. 4.
Figure 4:
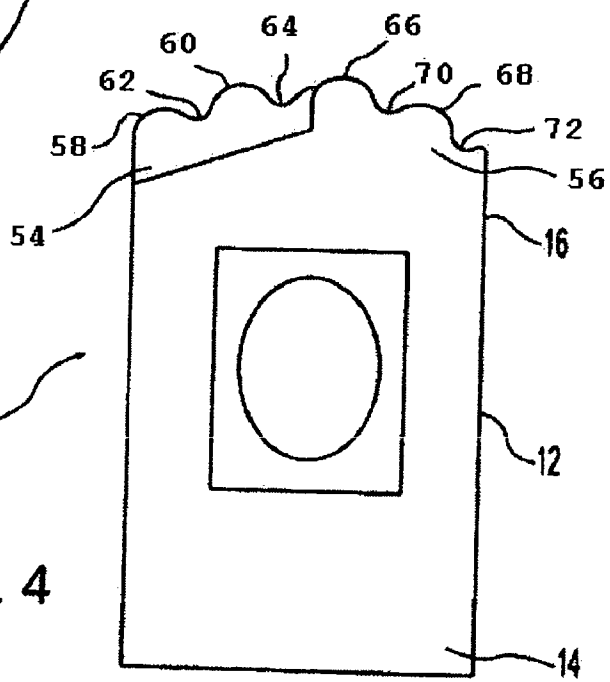
FIG. 4 is a view in side elevation of another embodiment of the drill bit, illustrating the asymmetrical arrangement of a pair of cutting teeth aligned with one another extending from the drill bit longitudinal axis.
Figure 5:
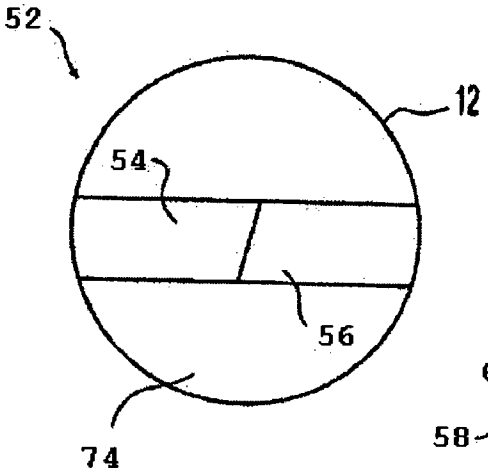
FIG. 5 is a sectional top plan view of the drill bit shown in FIG. 4.

As shown in FIG. 6, the cutting teeth 54, 56 are integral with a supporting surface 74 having surface portions 76, 78 separated by a wall 80. The cutting tooth extends from the surface portion 76 and the cutting tooth 56 extends from the surface portion 78, both in a direction parallel to a longitudinal axis 24 of body portion 12 that runs from the drill steel engaging portion 14 to the cutting end portion 16. In comparison with the embodiment of the cutting teeth 18 and 20 for the drill bit 10 shown in FIGS. 1-3, the cutting teeth 54, 56 for the embodiment of the drill bit 10 shown in FIGS. 4-6 are longitudinally aligned across the diameter of the cylindrical body portion 12. The cutting teeth 54, 56 are not laterally offset from one another as are the cutting teeth 18 and 20 as shown in FIG. 2. As shown in FIG. 5, the cutting teeth 54, 56 form a one-piece construction with an asymmetrical configuration, as above described. In this regard, the cutting teeth 54, 56 also cut at a lower temperature and experience an extended operating life.

As shown in FIGS. 4 and 6, each cutting tooth 54, 56 includes a plurality of integral cutting elements 58, 60, 66, 68. The cutting elements 58, 60, 66, 68 are asymmetrically positioned from one another. The cutting elements 58, 60, 66, 68 radiate outwardly from the center of the supporting surface 74. The cutting elements 58, 60 are spaced apart from one another on the cutting tooth 54. The cutting elements 66, 68 are spaced apart from one another on the cutting tooth 56. The cutting elements 58, 60 are raised relative to the surface 74 with respect to the edge portions 62, 64. The cutting elements 64, 66 are raised relative to the surface 74 with respect to the edge portions 70, 72. Each cutting element 58, 60, 64, 68 is positioned to create a unique cutting pattern on a working surface, as diagrammatically represented in FIG. 6 by the lines 82, 84, 86, and 88 which stimulate the cutting paths of the cutting elements 58, 60, 64, 68.

The first cutting element 56 is positioned adjacent to the cylindrical body portion 12. The second cutting element 58 is positioned between edge portions 62, 64. The cutting elements 58, 60 and the edge portions 62, 64 have arcuate edges to create a sinusoidal profile having the appearance of alternating peaks and valleys when viewed in perspective, as shown in FIGS. 4 and 6. Preferably, the cutting elements 58, 60 have a width corresponding to the width of the lowered arcuate edge portion 62. However, the width of the cutting elements 58, 60 is not critical.

The cutting elements 66, 68 of the second cutting tooth 56 are separated from one another by the lowered arcuate edge portion 70. The second cutting element 68 is positioned between the lowered arcuate edge portions 70, 72. Lowered arcuate edge portion 72 is positioned adjacent to the exterior surface 12. Lowered arcuate edge portion 64 abuts the cutting element 66 along the longitudinal axis 24. The cutting elements 66, 68 and the edge portions 70, 72 have arcuate edges to create a sinusoidal profile having the appearance of alternating peaks and valleys when viewed in perspective, as shown in FIGS. 4 and 6. Preferably, the cutting elements 66, 68 have a width corresponding to the width of the lowered arcuate edge portion 70. However, the width of the cutting elements 66, 68 is not critical.

Figure 7:
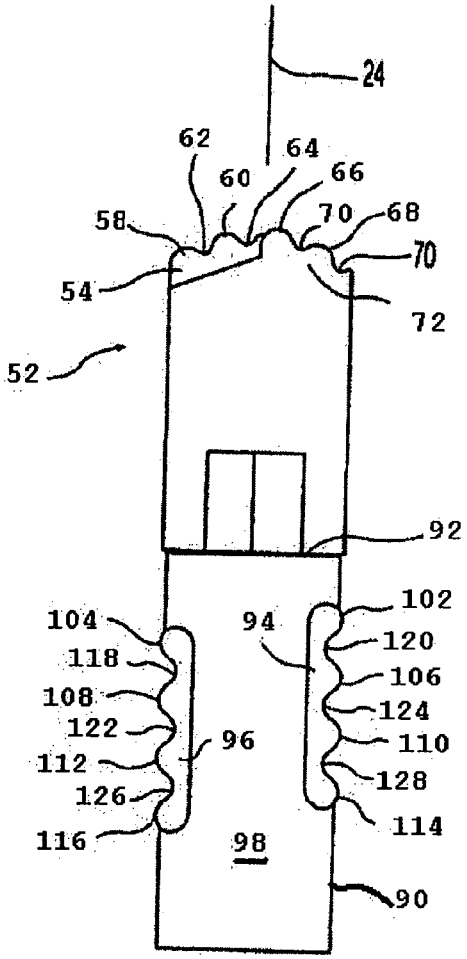
FIG. 7 is a view in side elevation of the drill bit shown in FIG. 4 attached to a shaft member having additional inserts extending therefrom.

Referring to FIG. 7, there is illustrated a connecting member or reamer bit 90 attached to the drill bit 52 through a conventional connection joint 92. The connecting member 90 connects to a drill steel, which is mounted in a conventional chuck assembly that allows the drill bit 52 and connecting member 90 to rotate together as the drill bit 52 bores through rock material. The reamer bit 90 is generally cylindrical and includes a plurality of inserts 94, 96 extending therefrom.

The inserts 94, 96 are asymmetrically spaced from one another along the cylindrical outer surface 98 of the reamer bit 90. The terms "cylindrical outer surface" or "cylindrical surface" refer to the outer surface of a cylindrical object or cylinder that does not include the upper or lower base surface. The inserts 94, 96 project outwardly from the cylindrical surface 98 in an essentially perpendicular direction relative to the longitudinal axis 24. The inserts 94, 96 are also essentially perpendicular to the cutting teeth 54, 56.

Each insert 94, 96 includes a plurality of cutting elements 102, 104, 106, 108, 110, 112, 114, 116 and lower edge portions 118, 120, 122, 124, 126, 128. The cutting elements 102, 104, 106, 108, 110, 112, 114, 116 and lower edge portions 118, 120, 122, 124, 126, 128 are arcuate in shape and have essentially the same width relative to one another. The cutting elements 102, 104, 106, 108, 110, 112, 114, 116 are raised relative to the cylindrical surface 98. The lower edge portions 118, 120, 122, 124, 126, 128 as shown in FIG. 7 are lowered relative to the cylindrical surface 98, so that the cutting elements 102, 104, 106, 108, 110, 112, 114, 116 and lower edge portions 118, 120, 122, 124, 126, 128 create the appearance of a row of peaks and valleys along the outer surface of reamer bit 90.

The inserts 94, 96 and cutting elements 102, 104, 106, 108, 110, 112, 114, 116 rotate about the longitudinal axis 24, as the connecting member 90 rotates. The rotating cutting elements 102, 104, 106, 108, 110, 112, 114, 116 move in along an essentially spiral path as the drill bit 52 and reamer bit 90 advance vertically in a direction parallel to the longitudinal axis 24.

As shown in FIG. 7, the asymmetrical spacing of the cutting elements 102, 104, 106, 108, 110, 112, 114, 116 produces a unique cutting pattern along the sides of the hole. The cutting element 102 contacts the interior surface of the hole to carve an essentially spiral channel. The cutting element 104 also contacts the interior surface to carve a second, adjacent spiral channel. Each subsequent cutting element 106, 108, 110, 112, 114, 116 also cuts a spiral channel in the hole interior surface.

The drill bit 52 and the reamer bit 90 shown in FIG. 7 cooperate with one another to create a large hole during drilling operations. The drill bit cutting teeth 56, 58 rotate about the longitudinal axis 24, so that the cutting elements 58, 60, 66, 68 carve essentially concentric circular holes in the working surface. The cutting elements 102, 104, 106, 108, 110, 112, 114, 116 extend outwardly from the reamer bit inserts 94, 96 to dislodge additional rock material during drilling operations and to create a straight hole of substantially uniform diameter for advancement of the bit in the bore hole.

The inserts 94, 96 are formed by the same manufacturing processes as the cutting teeth 54, 56. The inserts 94, 96 include a hard layer that forms the cutting elements 102, 104, 106, 108, 110, 112, 114, 116. Preferably, the cutting elements 102, 104, 106, 108, 110, 112, 114, 116 are integral with the inserts 94, 96.

Figure 8:
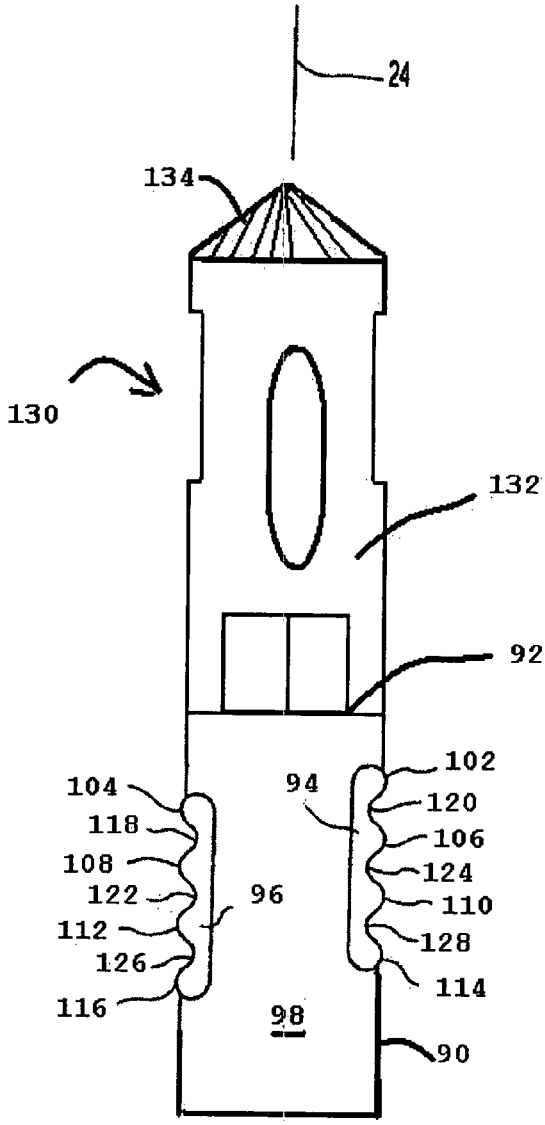
FIG. 8 is a view in side elevation of a conventional drill bit attached to a shaft member having the reamer bit shown in FIG. 7.

Referring now to FIG. 8, there is illustrated another embodiment of a drill steel generally designated by the numeral 130 in which like elements are also identified by numerals shown in FIGS. 1-7. The drill steel 130 includes a reamer bit 90, connection joint 92, and a drill bit 132. Contrary to the embodiment shown in FIG. 7, the drill bit 132 shown in FIG. 8 is a conventional drill bit, such as the drill bit disclosed in U.S. Pat. No. 3,252,525 incorporated herein by reference.

The drill bit 132 and the reamer bit 90 shown in FIG. 8 cooperate with one another to produce an essentially cylindrical hole during drilling operations. The drill bit 132 includes a cutting surface 134 that rotates about the longitudinal axis 24 to cut an initial essentially cylindrical hole in a work surface (not shown). The cutting elements 102, 104, 106, 108, 110, 112, 114, 116 extend outwardly from the reamer bit inserts 94, 96 to dislodge additional rock material during drilling operations and to create a straight hole of substantially uniform diameter for advancement of the bit in the bore hole.

Figure 9:
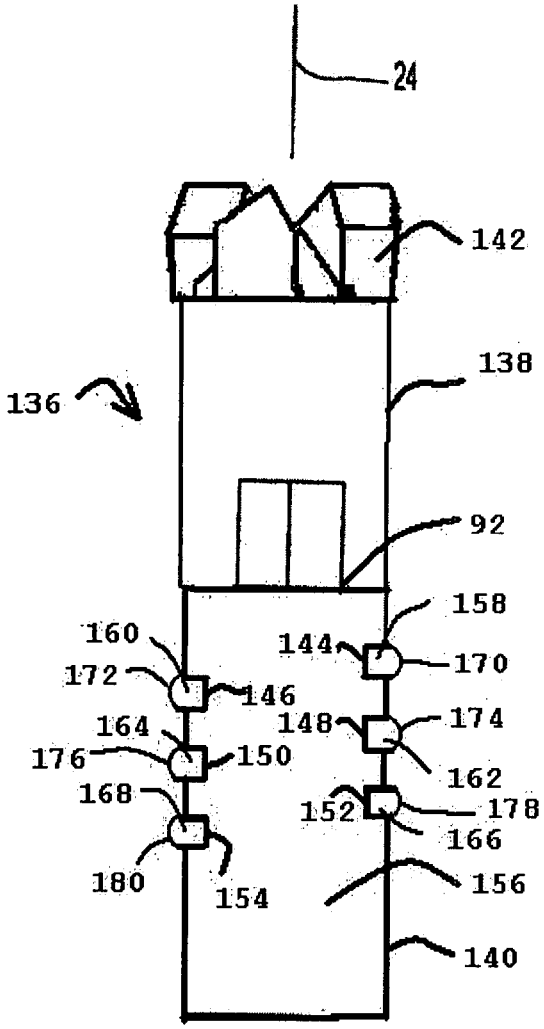
FIG. 9 is a view in side elevation of another conventional drill bit attached to a shaft member having another embodiment of a reamer bit with asymmetrically positioned cutting elements.

Referring now to FIG. 9, there is illustrated another embodiment of a drill steel generally designated by the numeral 136 in which like elements are also identified by numerals shown in FIGS. 1-8. The drill steel 136 includes a conventional drill bit 138, connection joint 92, and a reamer bit 140. Contrary to the embodiment shown in FIGS. 7-8, the drill bit 138 shown in FIG. 9 includes cutting means 142 corresponding to U.S. Pat. No. 3,592,276, which is incorporated herein by reference.

The reamer bit 140 includes a plurality of inserts 144, 146, 148, 150, 152, 154 asymmetrically positioned on an essentially cylindrical cutting surface 156. Each insert 144, 146, 148, 150, 152, 154 includes a cutting element 158, 160, 162, 164, 166, 168. Each cutting element 158, 160, 162, 164, 166, 168 includes a radiused or essentially arcuate cutting edge 170, 172, 174, 176, 178, 180 projecting outwardly from the cutting surface 156.

The drill steel 136 is positioned in an overlying relationship with a work surface (not shown) to produce a hole. The drill steel 136 is rotated to engage the drill bit 138 with the work surface to form an essentially cylindrical hole. The drill steel 136 is driven into the hole to allow insertion of the reamer bit 140. As shown in FIG. 9, the inserts 144, 146, 148, 150, 152, 154 extend from the cutting surface 156, so that the cutting elements 158, 160, 162, 164, 166, 168 contact the hole interior surface.

The cutting elements 158, 160, 162, 164, 166, 168 are asymmetrically positioned to produce a unique cutting pattern along the sides of a hole. The cutting element 158 contacts the interior surface of the hole to carve a channel. The cutting element 158 also contacts the interior surface to carve a second, adjacent channel as the drill steel 136 is driven forward in a hole. Each cutting element 162, 164, 166, 168 also cut channels in the hole interior surface, so that the hole diameter is increased.

The inserts 144, 146, 148, 150, 152, 154 shown in FIG. 9 are formed from any suitable material using any suitable manufacturing process. Preferably, the inserts 144, 146, 148, 150, 152, 154 are formed using the materials and processes that are used to form the cutting elements 30, 32 shown in FIGS. 1-3. The inserts 144, 146, 148, 150, 152, 154 are attached to the reamer bit 140 using any suitable material through a suitable joining process. Preferably, the inserts 144, 146, 148, 150, 152, 154 are attached to the reamer bit 140 through the use of a suitable solder.

Figure 10:
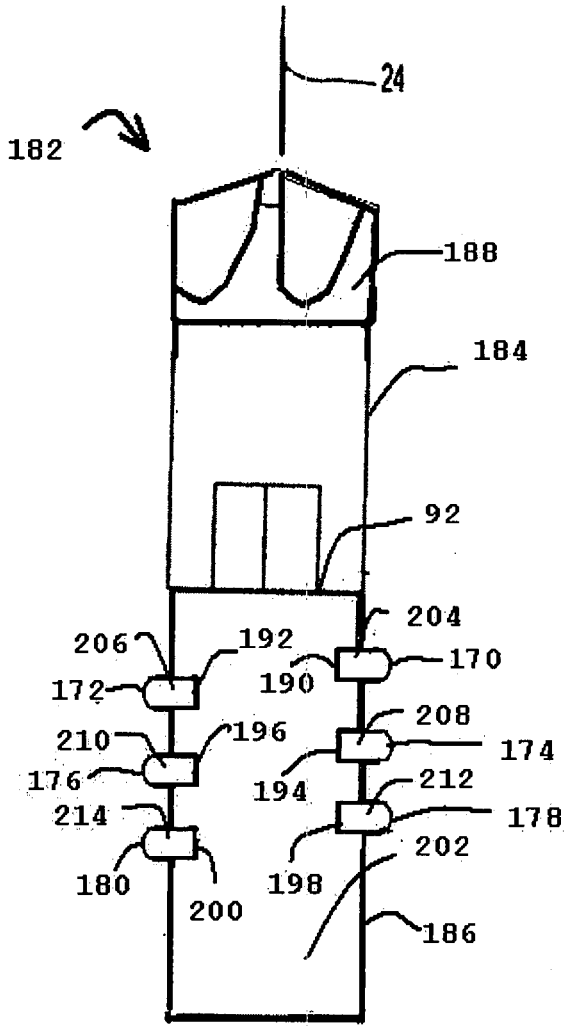
FIG. 10 is a view in side elevation of another conventional drill bit attached to a shaft member having another embodiment of a reamer bit with elongated cutting elements.

Now referring to FIG. 10, there is illustrated another embodiment of a drill steel generally designated by the numeral 182 in which like elements are also identified by numerals shown in FIGS. 1-9. The drill steel 182 includes a conventional drill bit 184, connection means 92, and a reamer bit 186. Contrary to the embodiment shown in FIGS. 7-9, the drill bit 184 shown in FIG. 10 includes cutting means 188 corresponding to U.S. Pat. No. 3,613,807, which is incorporated herein by reference.

The reamer bit 186 includes a plurality of inserts 190, 192, 194, 196, 198, 200 asymmetrically positioned on an essentially cylindrical cutting surface 202. The inserts 190, 192, 194, 196, 198, 200 shown in FIG. 10 are essentially identical to the inserts 144, 146, 148, 150, 152, 154 shown in FIG. 9 except that each insert 190, 192, 194, 196, 198, 200 includes an elongated portion 204, 206, 208, 210, 212, 214 that allows the cutting edges 170, 172, 174, 176, 178, 180 to project outwardly further from the cutting surface 202 that the cutting surface 156 on the reamer bit 140.

Figure 11:
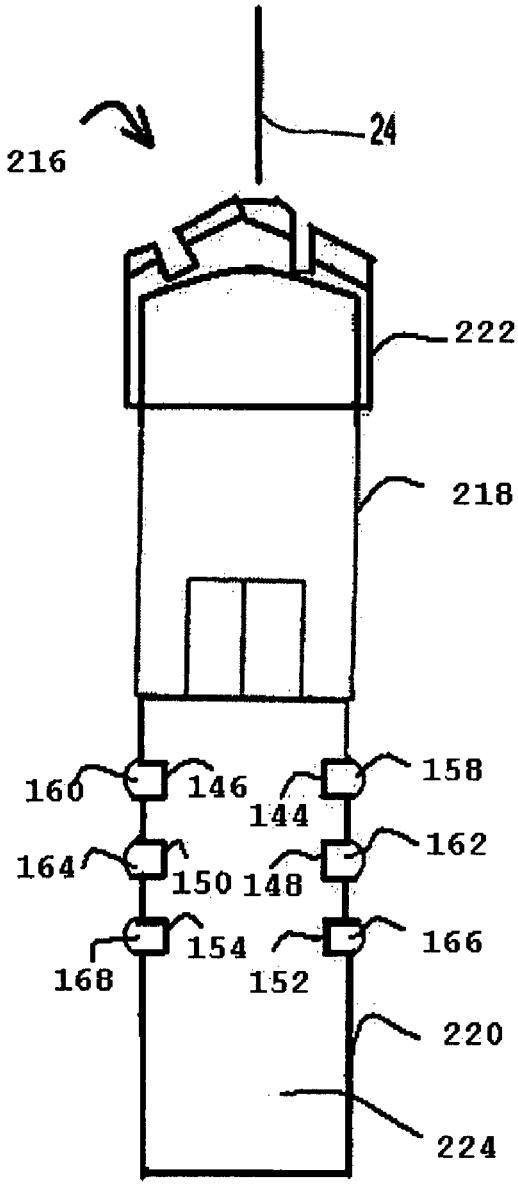
FIG. 11 is a view in side elevation of a conventional rock drill bit attached to a shaft member having another embodiment of a reamer bit.

Referring now to FIG. 11, there is illustrated another embodiment of a drill steel generally designated by the numeral 216 in which like elements are also identified by numerals shown in FIGS. 1-10. The drill steel 216 includes a conventional drill bit 218, connection means 92, and a reamer bit 220. Contrary to the embodiment shown in FIGS. 7-10, the drill bit 218 includes cutting means 222 corresponding to U.S. Pat. No. 6,588,520, which is incorporated herein by reference.

The reamer bit 220 includes a plurality of inserts 144, 146, 148, 150, 152, 154 positioned on an essentially cylindrical cutting surface 224. Contrary to the embodiment shown in FIG. 9, the inserts 144, 146, 148, 150, 152, 154 shown in FIG. 11 are not asymmetrically positioned. Insert 144 is positioned at essentially the same position as insert 146 along the longitudinal axis 24. Insert 148 is positioned at essentially the same position as insert 150 along the longitudinal axis 24. Insert 152 is positioned at essentially the same position as insert 154 along the longitudinal axis 24.

The positioning of the inserts 144, 146, 148, 150, 152, 154 as shown in FIG. 11 produces a unique cutting pattern along the sides of a hole, as the drill steel 216 is driven into the hole. The cutting element 158 extends from the insert 144 to carve an essentially cylindrical channel in the hole interior surface. The cutting element 158 extends from the insert 146 to carve a second essentially cylindrical channel. The remaining inserts 148, 150, 152, 154 include cutting elements 162, 164, 166, 168 that also cut adjacent cylindrical channels to ream out the hole interior surface.

Figure 12:
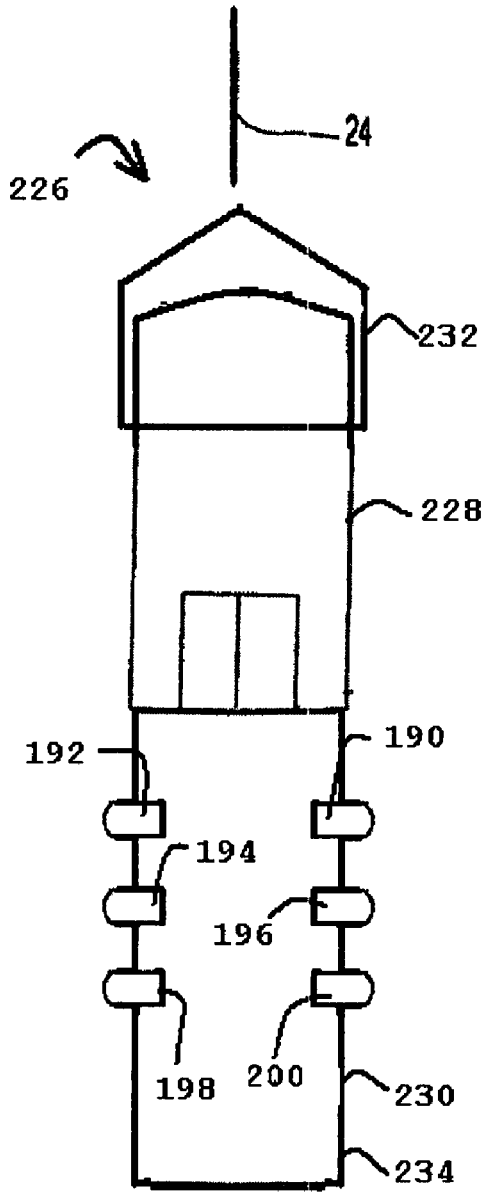
FIG. 12 is a view in side elevation of a conventional roof drill bit attached to a shaft member having another embodiment of a reamer bit.

Referring now to FIG. 12, there is illustrated another embodiment of a drill steel generally designated by the numeral 226 in which like elements are also identified by numerals shown in FIGS. 1-11. The drill steel 226 includes a conventional drill bit 228, connection joint 92, and a reamer bit 230. Contrary to the embodiment shown in FIGS. 7-11, the drill bit 228 includes cutting means 232 disclosed in U.S. Pat. No. 5,433,281, which is incorporated herein by reference.

Contrary to the embodiment shown in FIG. 11, the reamer bit 230 shown in FIG. 12 includes a plurality of elongated inserts 190, 192, 194, 196, 198, 200 positioned on an essentially cylindrical cutting surface 234. The inserts 190, 192, 194, 196, 198, 200 are not asymmetrically positioned on the surface 234.

Figure 13:
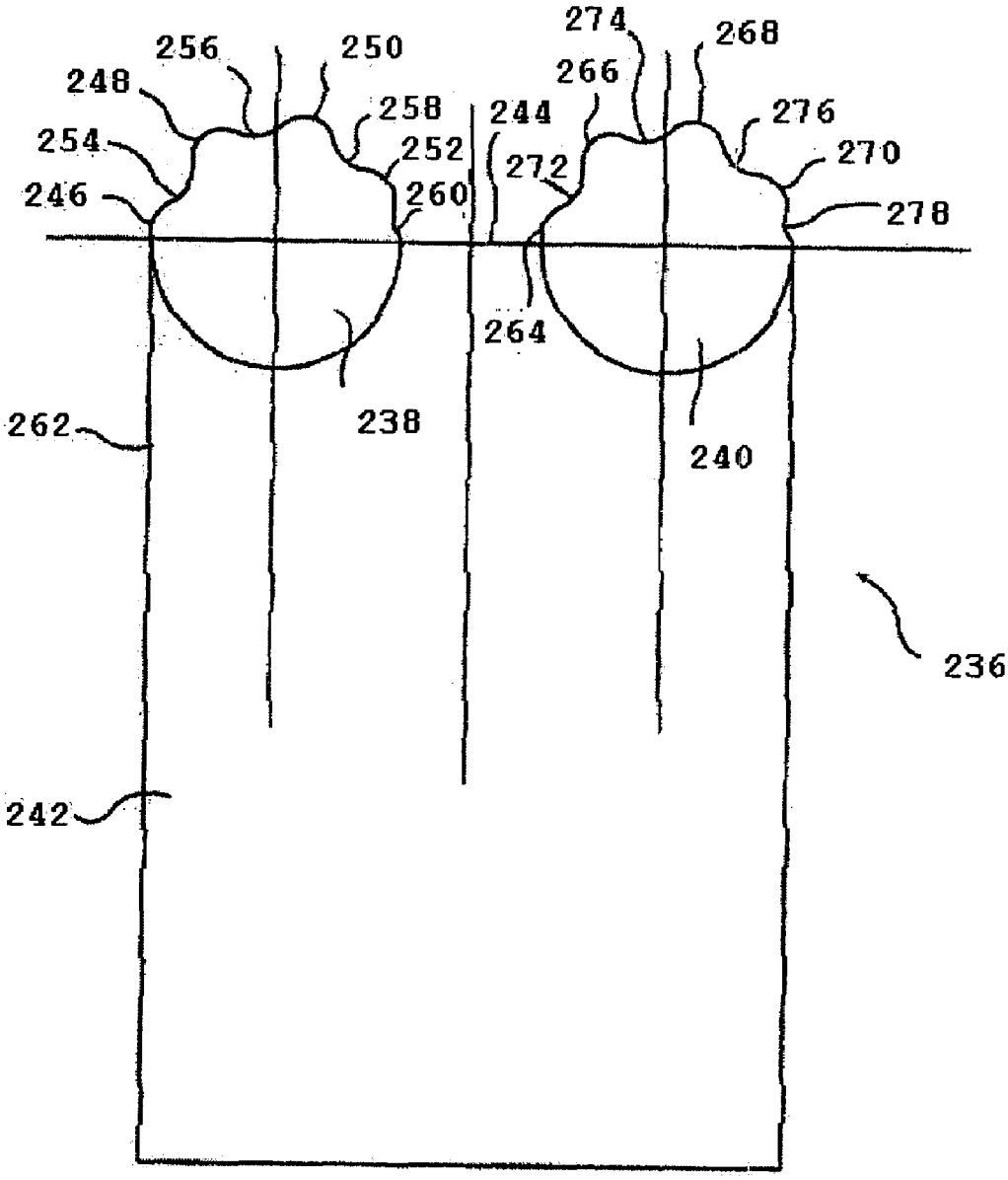
FIG. 13 is a developed view of the drill bit, illustrating the profiles of the pair of cutting teeth.

Now referring to FIG. 13, there is illustrated another embodiment of the present invention including a drill bit 236 in which like elements are also identified by like numerals shown in FIGS. 1-12. Contrary to the embodiment illustrated in FIGS. 1-12, the cutting teeth 238, 240 shown in FIG. 13 differ in construction from the cutting teeth 18, 20 illustrated in FIGS. 1-3. The cutting teeth 238, 240 are inserts that extend from the cylindrical body portion 242 of the drill bit 236. Also, the cutting teeth 238, 240 do not abut one another. Instead, the cutting teeth 238, 240 are positioned along a surface 244 in a spaced apart manner.

The cutting teeth 238, 240 shown in FIG. 13 are asymmetrically spaced and juxtaposed from one another. Cutting tooth 238 includes a plurality of cutting elements 246, 248, 250, 252 with raised arcuate edges extending therefrom. Cutting tooth 238 also includes a plurality of lowered arcuate edge portions 254, 256, 258, 260. The cutting elements 246, 248, 250, 252 alternate positions with the lowered edge portions 254, 256, 258, 260 along the outer surface of the cutting tooth 238. The cutting element 246 is positioned adjacent to an outer surface 262 of the drill bit 236. The edge portion 260 is positioned adjacent to the surface 244.

Cutting tooth 240 includes a plurality of cutting elements 264, 266, 268, 270 with raised arcuate edges extending therefrom. Cutting tooth 240 also includes a plurality of lowered arcuate edge portions 272, 274, 276, 278. As shown in FIG. 13, the cutting elements 264, 266, 268, 270 alternate positions with the lowered edge portions 272, 274, 276, 278 along the outer surface of the cutting tooth 240. The edge portion 278 is positioned adjacent to an outer surface 262 of the drill bit 236. The cutting element 262 is positioned adjacent to the surface 244. The lower edge portion 260 is positioned opposite to and faces the cutting element 266 along the surface 244.

The cutting teeth 238, 240 as shown in FIG. 13 are offset from one another to produce a unique cutting pattern during drilling operations. As the drill bit 236 rotates, cutting element 250 extends from cutting tooth 238 to contact the drilling surface and to carve a circular trough in the rock material. Cutting element 268 extends from cutting tooth 240 to contact the drilling surface and to carve a second concentric circular trough in the rock material, which is adjacent to the trough created by cutting element 250. The remaining cutting elements 246, 248, 252, 264, 266, 270 carve similar concentric troughs in the drilling surface.

It should be understood that alternative drill bits are contemplated in accordance with the present invention and include drill bits having inserts, and more particularly, inserts that have asymmetrically positioned cutting elements. The inserts comprise cutting teeth with cutting elements or cutting elements alone.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A method for drilling a work surface comprising the steps of:

providing an essentially cylindrical drill steel having a drill bit and a reamer bit with a plurality of essentially arcuate cutting elements in an overlying relationship with the work surface, rotating the drill steel to engage the drill bit with the work surface to form an essentially cylindrical hole therein, driving the drill steel into the hole to insert the reamer bit therein, extending a first arcuate cutting element from a first insert positioned on a cutting surface of the reamer bit, extending a second arcuate cutting element from a second insert asymmetrically positioned on the reamer bit cutting surface relative to the first insert so that the first cutting element is essentially offset from the second cutting element, contacting the first arcuate cutting element with the hole cylindrical surface, contacting the second arcuate cutting element with the hole cylindrical surface, rotating the drill steel to carve a first essentially spiral channel in the hole interior surface with the first arcuate cutting element to increase the hole diameter, and rotating the drill steel to carve a second essentially spiral channel adjacent to the first essentially spiral channel in the hole interior surface with the second arcuate cutting element to increase the hole diameter.

2. A method as set forth in claim 1 which includes:

carving a plurality of essentially spiral channels with each of the inserts.

3. A method as set forth in claim 1 which includes:

removing dislodged material from a pocket formed on a cutting surface of the drill bit.

4. An apparatus for drilling a work surface comprising:

a drill steel having a drill bit at one end and a reamer bit adjacent to said drill bit, said drill bit having a cutting surface positioned at one end, pair of abutting asymmetrically spaced cutting teeth projecting outwardly from said drill bit cutting surface and a pocket for removing dislodged material, said cutting teeth having means for carving a plurality of adjacent concentric channels in the working surface to form a hole, said reamer bit having a cutting surface positioned along an outer cylindrical surface with a pair of inserts projecting outwardly from said reamer bit cutting surface and being essentially perpendicular to said drill bit cutting teeth, said inserts being asymmetrically spaced along said reamer bit cutting surface, and said inserts having means for carving a plurality of essentially adjacent channels in the working surface to remove additional material to increase the hole diameter.

5. An apparatus as set forth in claim 4 in which:

said drill bit cutting surface includes a first support surface and a second support surface, said first cutting tooth extending from said first support surface, and said second cutting tooth extending from said second support surface.

6. An apparatus as set forth in claim 5 in which:

a wall separating said first and second support surfaces, and said wall, said second cutting tooth, and said second support surface forming said pocket.

7. An apparatus as set forth in claim 4 in which:

said drill bit cutting surface includes a layer of hard material forming a coating thereon.

8. An apparatus as set forth in claim 4 in which:

said reamer bit cutting surface includes a layer of hard material forming a coating thereon.

9. An apparatus as set forth in claim 4 in which:

said drill bit cutting surface includes a layer of hard material forming a coating thereon, said reamer bit cutting surface includes a layer of hard material forming a coating thereon, and said drill bit cutting surface layer and said reamer bit cutting surface layer include a material selected from the group consisting of diamond, polycrystalline diamond, diamond-like carbon, thermally stable product diamond, impregnated diamond, surface set diamond, cubic boron nitride, titanium nitride, and carbon nitride.

10. An apparatus as set forth in claim 4 which includes:

said cutting teeth being integral with means for carving a plurality of adjacent concentric channels in the working surface.

11. An apparatus as set forth in claim 4 which includes:

said inserts being integral with means for carving a plurality of essentially adjacent channels in the working surface.

12. An apparatus for drilling a work surface comprising:

a drill steel having a drill bit at one end and a reamer bit adjacent to said drill bit, said drill bit having a cutting surface positioned at one end with a first support surface, a second support surface, and a pocket for removing dislodged material, said drill bit first support surface having a first cutting tooth extending therefrom for forming a hole in the work surface, said drill bit second support surface having a second cutting tooth extending therefrom for increasing the diameter of the hole in the work surface, said reamer bit having a cutting surface positioned along an outer cylindrical surface with a pair of inserts projecting outwardly from said reamer bit cutting surface and being essentially perpendicular to said drill bit first cutting tooth and said drill bit second cutting tooth, and said inserts having cutting elements for carving a plurality of essentially adjacent channels in the working surface to remove additional material to increase the hole diameter.

13. An apparatus as set forth in claim 12 which includes:

said first cutting tooth abutting said second cutting tooth.

14. An apparatus as set forth in claim 12 which includes:

said first cutting tooth being asymmetrically spaced from said second cutting tooth.

15. An apparatus as set forth in claim 12 which includes:

said first cutting tooth and said second cutting tooth having means for carving a plurality of adjacent concentric channels in the working surface.

16. An apparatus as set forth in claim 12 in which:

said drill bit cutting surface includes a layer of hard material forming a coating thereon.

17. An apparatus as set forth in claim 12 in which:

said reamer bit cutting surface includes a layer of hard material forming a coating thereon.

18. An apparatus as set forth in claim 12 in which:

said drill bit cutting surface includes a layer of hard material forming a coating thereon, said reamer bit cutting surface includes a layer of hard material forming a coating thereon, and said drill bit cutting surface layer and said reamer bit cutting surface layer include a material selected from the group consisting of diamond, polycrystalline diamond, diamond-like carbon, thermally stable product diamond, impregnated diamond, surface set diamond, cubic boron nitride, titanium nitride, and carbon nitride.

19. An apparatus as set forth in claim 12 which includes:

said drill bit first support surface, second support surface, said first cutting tooth, and said second cutting tooth being integral.

20. An apparatus as set forth in claim 12 which includes:

said reamer bit inserts being integral with said reamer bit cutting elements.

* * * * *